US009771198B2

(12) United States Patent
Stuhlmann

(10) Patent No.: US 9,771,198 B2
(45) Date of Patent: Sep. 26, 2017

(54) CLUSTER PACK AND PRODUCTION METHOD

(71) Applicant: KHS GmbH, Dortmund (DE)

(72) Inventor: Christopher Stuhlmann, Korbach (DE)

(73) Assignee: KHS GmbH, Dortmund (DE)

( * ) Notice: Subject to any disclaimer, the term of this patent is extended or adjusted under 35 U.S.C. 154(b) by 3 days.

(21) Appl. No.: 14/422,828

(22) PCT Filed: Aug. 19, 2013

(86) PCT No.: PCT/EP2013/002495
§ 371 (c)(1),
(2) Date: Jun. 4, 2015

(87) PCT Pub. No.: WO2014/029491
PCT Pub. Date: Feb. 27, 2014

(65) Prior Publication Data

US 2015/0307249 A1 Oct. 29, 2015

(30) Foreign Application Priority Data

Aug. 20, 2012 (DE) ..... 10 2012 016 339

(51) Int. Cl.

| | |
|---|---|
| ***B65D 71/08*** | (2006.01) |
| ***B65D 71/10*** | (2006.01) |
| ***B65B 51/02*** | (2006.01) |
| ***B65B 53/00*** | (2006.01) |
| ***B65B 61/14*** | (2006.01) |
| ***B65D 71/36*** | (2006.01) |

(52) U.S. Cl.
CPC ..... *B65D 71/08* (2013.01); *B65B 51/02* (2013.01); *B65B 53/00* (2013.01); *B65B 61/14* (2013.01); *B65D 71/10* (2013.01); *B65D 71/36* (2013.01); *B65D 2313/10* (2013.01)

(58) Field of Classification Search
CPC ..... B65D 72/08; B65D 71/10; B65D 71/36; B65D 53/00; B65D 52/02; B65D 2313/10
USPC ..... 206/147, 150, 153, 162, 139–203
See application file for complete search history.

(56) References Cited

U.S. PATENT DOCUMENTS

| | | | | | |
|---|---|---|---|---|---|
| 3,219,183 | A * | 11/1965 | Potter | B65D 71/10 | 206/162 |
| 3,425,544 | A * | 2/1969 | Ayer | B65D 71/10 | 206/497 |
| 4,754,879 | A * | 7/1988 | Benno | B65D 5/28 | 206/200 |
| 5,492,222 | A * | 2/1996 | Weaver | B65D 71/504 | 206/150 |
| 5,813,540 | A * | 9/1998 | Vollbrecht | B65D 5/2019 | 206/427 |
| 7,726,464 | B2 | 6/2010 | Cerf | | |

(Continued)

FOREIGN PATENT DOCUMENTS

| | | |
|---|---|---|
| AT | 504 227 | 4/2011 |
| DE | 16 88 167 | 12/1954 |

(Continued)

*Primary Examiner* — Chun Cheung
(74) *Attorney, Agent, or Firm* — Occhiuti & Rohlicek LLP

(57) ABSTRACT

In a cluster pack, encompassing elements encompass containers. One encompassing element includes shrink film; the other, which has an integrated carrying element, defines a ring surrounding the containers.

22 Claims, 3 Drawing Sheets

(56) References Cited

U.S. PATENT DOCUMENTS

| | | | | |
|---|---|---|---|---|
| 7,775,349 | B2 * | 8/2010 | Walker | B65D 71/10 206/162 |
| 7,793,779 | B2 * | 9/2010 | Spivey, Sr. | B65D 71/066 206/153 |
| 8,196,372 | B2 * | 6/2012 | Perl | B65B 27/04 206/150 |
| 2004/0055905 | A1 * | 3/2004 | Marco | B65D 71/504 206/150 |
| 2008/0190785 | A1 * | 8/2008 | Spivey | B65D 71/066 206/147 |

FOREIGN PATENT DOCUMENTS

| | | |
|---|---|---|
| DE | 23 31 193 | 1/1975 |
| DE | 41 26 212 | 2/1993 |
| DE | 10 2006 037 105 | 2/2008 |
| DE | 10 2009 025 824 | 11/2010 |
| DE | 10 2009 044 271 | 4/2011 |
| EP | 0 527 451 | 2/1993 |
| EP | 2 096 039 | 9/2009 |
| FR | 2 590 544 | 5/1987 |
| WO | WO2009/039544 | 4/2009 |
| WO | WO2013/104534 | 7/2013 |
| WO | WO2013/156532 | 10/2013 |

* cited by examiner

CLUSTER PACK AND PRODUCTION METHOD

RELATED APPLICATIONS

This application is the national stage under 35 USC 371 of international application PCT/EP2013/002495, filed on Aug. 19, 2013, which claims the benefit of the Aug. 20, 2012 priority date of German application DE 102012016339.8, the content of which is herein incorporated by reference.

FIELD OF DISCLOSURE

This disclosure relates to a cluster pack and to a method for producing the cluster pack.

BACKGROUND

Known methods of making a cluster pack begin with a wide stream of randomly-oriented containers standing on a transport plane of a transporter with their container axes oriented vertically. Lane dividers then convert the wide container stream into single-track container streams. In further method steps, the containers that are to be formed into a cluster pack are divided off from the single-lane container streams. The required number of containers is combined to form a consolidated container group in which the containers bear against one another by a plurality of circumferential surfaces, or contact surfaces. The containers of each container group are then bound to form a compact and stable cluster pack.

A number of ways are known for binding the containers together. One way is to use shrink films. Another way is to encompass the containers with a band.

One disadvantage of using bands is that, when a container is first removed from a banded cluster pack, the band can no longer securely hold the remaining containers. This is true even if the band is never cut. Even without cutting the band, removing a container will disrupt the integrity of the cluster pack.

Another problem that arises is that when such cluster packs are being transported, vibrations or mechanical disturbances can cause cylindrical articles, such as cans, bottles or containers, to slide into the gap in the neighboring row. This behavior, which is often called "nesting," can be prevented by maintaining the bands under very high tension.

Another known method for assembling packs of bottles, uses rotary starwheels on both sides of a path to press bottle necks into clamps on flat carriers. A band or sheath can then encompass the resulting pack of bottles.

It is also known to apply adhesive to containers in narrow areas or rows. Adjacent areas, which are not provided with adhesive, then allow the pack to be gripped for carrying. In these cluster packs, containers stick to one another at the adhesive sites. Also known is providing containers with an adhesive and arranging a shrink film around the containers.

In the case of tall, long containers, a large overlapping length of film is required to reasonably fill a shrink gap. This leads to a high material consumption and thus to considerable film costs. Additionally, long film ends at the sides laminate very poorly to one another. In a shrink tunnel, they shrink unevenly. This results in a wrinkly appearance. Such an appearance can create an impression of substandard quality and thus diminish sales.

The containers of a cluster pack usually have a container code, such as a barcode or a QR code, that can be read by a suitable reader. The container code contains information for the retailer. It is useful for each container to have such a code so that individual containers can be removed from the cluster pack and sold one at a time.

In some cases, one may wish to sell the cluster as a whole. In that case it is useful to have a cluster code on the shrink film that is arranged around the cluster pack so that a code-reader can detect the price of the cluster pack.

A problem that can arise when there is both a cluster code and a container code is that the reader may read the wrong code. Instead of reading the code for the cluster pack, the reader ends up reading the code for a container. This can result in a cluster pack being sold for the price of a container. Although this may be a boon for a consumer, it is a considerable disadvantage for the retailer.

It is also known to provide the cluster pack with a carrying handle that is connected as a film strap to some of the PET bottles or even to the encompassing shrink film to form a carrying loop. This enables the cluster to be carried by one hand. However, because a cluster can be quite heavy, the film strap can press into the carrying hand and quickly inflict considerable pain. Thus, even when a strap is provided, a consumer will often lift the cluster pack by its bottom. This defeats the purpose of the film strap, namely that of having a second hand free.

SUMMARY

The problem addressed by the present invention is that of providing a cluster pack, as well as a method for producing cluster packs, in which the aforementioned disadvantages can be avoided. The resulting cluster pack is intended to reduce consumption of shrink film, avoid a wrinkly appearance, be easy to carry without using a carrying loop, and ensure that a cluster code can be read without the reader detecting individual container codes when the cluster pack is passed to the reader.

In one aspect, the invention features a cluster pack in which at least one encompassing element is a film, in particular a shrink film, and at least one encompassing element has an integrated carrying element or a carrying section and surrounds the grouped containers in the manner of a ring or band.

The invention also includes, in another aspect, a method that includes bringing together a predetermined number of containers, and surrounding them with an encompassing element, such as a banner or casing element. The method includes an optional step of applying adhesive or glue at least to corner containers of the cluster pack. A shrink film is then applied to surround and encompass the cluster pack. Some practices also include application of adhesive or glue for attachment of the shrink film.

The cluster pack is then fed to the shrinking device, which shrinks the shrink film. The end result is a cluster pack that has outer and inner encompassing element. In the particular embodiment, the inner encompassing element is a banner or casing element, and the outer encompassing element is the shrink film. The carrying element or the carrying section is integrated in the inner encompassing element.

In one embodiment, the encompassing element has the integrated carrying element, or an integrated carrying section, on at least one end face thereof.

In another embodiment, the encompassing element is a banner, preferably a wide banner, that is placed around the cluster pack. The placement of the banner and its dimensions, in particular its width, are chosen to cover selected container codes, such as barcodes or QR codes. In one embodiment, the banner is arranged around a belly region of the containers of the cluster pack.

In some embodiments, the banner is formed from cardboard, or corrugated cardboard. In other embodiments, the carrying element that is integrated into the banner is punched out of the banner.

In yet other embodiments, the carrying element has grip openings arranged above and below a handle element.

Additional embodiments include those in which the handle element has weakened areas of material, such as grooves. These weakened areas can be used to form bendable tabs. When bent in the direction of the handle element, preferably backwards behind the handle element, these tabs enhance the handle element's effective grip strength. The resulting carrying element, being thicker than those made by film straps, spreads the weight of the cluster pack over a larger area, thus reducing the pressure that might otherwise cause it to cut into the hand of one who is carrying the cluster pack. This overcomes the disadvantage of film straps, which can inflict considerable pain on the carrier's hand while the carrier carries a heavy cluster pack over even a short distance.

In a further embodiment, the tabs are bent along a line of weakening in a manner oriented away from the cluster pack. The result is a carrying element that, when held by a person carrying the pack, forms a structure with a triangular cross-section. A carrying element having such a shape makes carrying the cluster pack much more pleasant.

To maintain the banner in a stable position, it is useful to arrange the banner around the containers in a force-fitting manner. In this case, the banner is under some tension as it engages around the containers of the cluster pack. The tensioning force only needs to be large enough so that the banner does not slip during further processing of the cluster pack.

It is possible to feed the banner to a subsequent cluster pack as a strip, with the ends of the strip preferably being connected to one another in an overlapping manner. For example, the ends of the strips can be glued to one another.

In a further embodiment, the banner is attached at least to corner containers of a cluster pack. In such cases, it is useful to provide an adhesive or glue to the corner containers to promote an adhesive bond between them and the banner.

Once the banner has been arranged around the cluster pack, the further encompassing element, for example, the shrink film, can be arranged around the cluster pack and the banner. The cluster pack is then fed to a shrinking device in which the shrink film is shrunk onto the cluster pack.

In some embodiments, prior to feeding the cluster pack to the shrinking device, the shrink film is glued to the banner at the end faces of the cluster pack. In some practices, the film's ends at the sides are glued to the banner at the end faces. In other practices, where there is no banner, the film's ends are glued to corner containers of the cluster pack.

Gluing the shrink film to the end faces of the cluster pack helps keep the shrink film in a stable position during the subsequent shrinking process. This makes it possible to avoid a large overlapping length of film at the end faces. In addition, because there is less of an overlap, this also avoids a wrinkly appearance.

In another aspect, the invention, features a cluster pack that has a banner between the optional shrink film and the containers of the cluster pack. The film is attached to the end faces of the cluster pack. The banner covers at least the container codes, thus making it harder to accidentally read them.

In one advantageous embodiment, the banner itself carries a cluster code that may comprise data concerning the cluster pack. For example, the cluster code may carry price information for the whole cluster pack. The carrying element is advantageously integrated in the banner, so that the cluster pack can easily be transported using one carrying hand. Because, as a result of the bent-over tabs, the carry element is wider and thicker than the banner thickness, it becomes easier to carry the cluster pack without the carrying element cutting into the carrier's hand.

In one particularly beneficial embodiment, the banner is printed upon. Information printed on the banner can include not only a code, but other information, including human-readable information. The banner, in such embodiments, is formed from cardboard, from thin card stock, from corrugated cardboard, or from a card/paper combination. Since the shrink film can be transparent, information printed upon the banner can easily be read.

Since the film ends do not overlap and also do not butt against one another some areas of the end faces of the cluster pack remain film-free. This film-free region is sometimes called a "shrink gap." In some embodiments, the integrated carrying element is arranged on such an end face. In other embodiments, the integrated carrying element or the integrated carrying section is arranged in the region of this shrink gap.

In one further embodiment, the encompassing element is designed as a casing that comprises the integrated carrying element or the integrated carrying section.

The casing may have a bottom part and optionally a top part. In one advantageous embodiment, the carrying element is integrated in the bottom part. In a preferred embodiment, the carrying element integrated in the casing is arranged on at least one end face. In the context of the invention, a ring-like or band-like encompassing element is a banner, preferably a wide banner, or a casing element that may optionally have a base on its bottom part.

In some embodiments, the carrying element is a grip recess that has a carrying web extending in one direction over the grip recess. The carrying web can thus be gripped when gripping into the grip recess.

In those embodiments that have a casing, the casing has a bottom part and an optional top. Either or both may be formed from plastic or, like the banner before, from cardboard, card, corrugated cardboard, or from a paper/card combination. In those embodiments that have the optional the top is suitably connected to the bottom part so that it is held in place while retaining its ability to be detached when desired.

Among the embodiments with the casing are those that include a shrink film, as described above in the case of those embodiments that have a banner.

Once the housing with its bottom part and the optional top is arranged around the cluster pack, a shrink film can be arranged around the cluster pack and the casing. The cluster pack is then fed to a shrinking device in which the shrink film is shrunk onto the cluster pack, or onto the casing.

In some embodiments, before being fed to the shrinking device, the shrink film is glued to the casing at the end faces of the cluster pack. Gluing the shrink film to the end faces of the casing holds the shrink film in a stable position even during the subsequent shrinking process. This tends to avoid a large overlapping length of film at the end faces. This in turn helps avoid a wrinkly appearance at the end faces is avoided because there is no overlapping of film ends at the sides. This is because the film's ends at the sides are glued to the casing at the end faces thereof.

In one aspect the invention features a cluster pack, having a carrying element, first and second encompassing elements, and a predetermined number of containers. The first encompassing element includes shrink film, and the second defines a ring that surrounds the containers. The carrying element is integrated into the second encompassing element.

In some embodiments, the carrying element includes a handle having a triangular cross section. In others the carrying element has a grip recess and a carrying web.

In some embodiments, the containers have container codes printed thereon. These embodiments include those in which the ring has a width that is selected to conceal the container codes, and those in which the ring is disposed to conceal the container codes. In either case, the container codes cannot be read from outside the cluster pack.

Embodiments also include those in which the second encompassing element includes an end face, with the integrated carrying element being integrated on the end face. Also included are embodiments in which the second encompassing element includes a banner, and those in which it is arranged around a belly region of the containers.

Further embodiments include various locations of the carrying element, including being disposed on an end face of the cluster pack, being disposed along a shrink gap, and being disposed along an opening in the first encompassing element.

In some embodiments, the carrying element includes grip openings, and a handle element, with the handle element having lines of weakening that define tabs. These tabs can be bent to provide a more comfortable grip.

In some embodiments, the second encompassing element is arranged inside the first encompassing element.

Other embodiments include glue that attaches the first encompassing element to surfaces of corner containers of the cluster pack.

In other embodiments, the shrink film, which is shrunken onto the cluster pack, wraps at least some areas of the cluster pack.

In other embodiments, the second encompassing element includes a banner. In these embodiments, the shrink film is glued to the banner at an end face of the cluster pack.

In yet other embodiments, the second encompassing element includes a casing that has a bottom part. In these embodiments, the carrying element is integrated into the bottom part.

Another aspect of the invention features a cluster pack in which encompassing elements encompass containers. One encompassing element includes shrink film; the other, which has an integrated carrying element, defines a ring surrounding the containers.

In yet another aspect, the invention features a method for manufacturing a cluster pack having a predetermined number of containers, a shrink film that encompasses the containers, and a carrying element that is integral with a ring that surrounds the containers. Such a method includes bringing the containers together to form a container arrangement, the container arrangement being conformal to the cluster pack, surrounding the container arrangement with the ring, wrapping the container arrangement, at least in some areas, with the shrink film, and feeding the wrapped container arrangement to a shrinking device for shrinking of the shrink film around the container arrangement, thereby forming the cluster pack.

For those cluster packs that have corner containers, alternative practices of the invention include applying adhesive to portions of the corner containers, and causing adhesion between the corner containers and either the shrink film or the ring.

Other practices include comprising causing adhesion between film ends of the shrink film and the ring at an end face of the container arrangement.

In the context of the invention, containers are for example bottles, cans, tubes or pouches, in each case made of metal, glass and/or plastic. The term "container" also includes PET bottles, and other packaging means, particularly those suitable for being filled with liquid or viscous products, but also containers that have already been combined into groups (multipacks). Such containers, for example PET bottles, have a contact area that is spherically curved so that the containers can, so to speak, roll against one another about a circumferential path, i.e. on a "rolling ring". In the case of glass bottles, once the bottle has been used multiple times this can be seen for example by the ring of wear that is usually visible in a lighter color. In the case of PET bottles, such "rolling rings" may be arranged not only in the top area but also in the bottom area.

As used herein, "containers" includes PET bottles, bottles, cans, tubes or pouches made of metal, glass and/or plastic, as well as other packaging means, particularly those suitable for being filled with liquid or viscous products, and containers that have already been combined into groups, or multipacks.

As used herein, "adhesives" and "glues" include materials or compounds that can be used to establish an adhesive bond between the components of the cluster pack.

BRIEF DESCRIPTION OF THE DRAWINGS

These and other features of the invention will be apparent from the following detailed description and the accompanying figures, in which.

In the various figures, identical parts are always provided with the same references, and for this reason they are generally also described only once.

DETAILED DESCRIPTION

Figure 1:
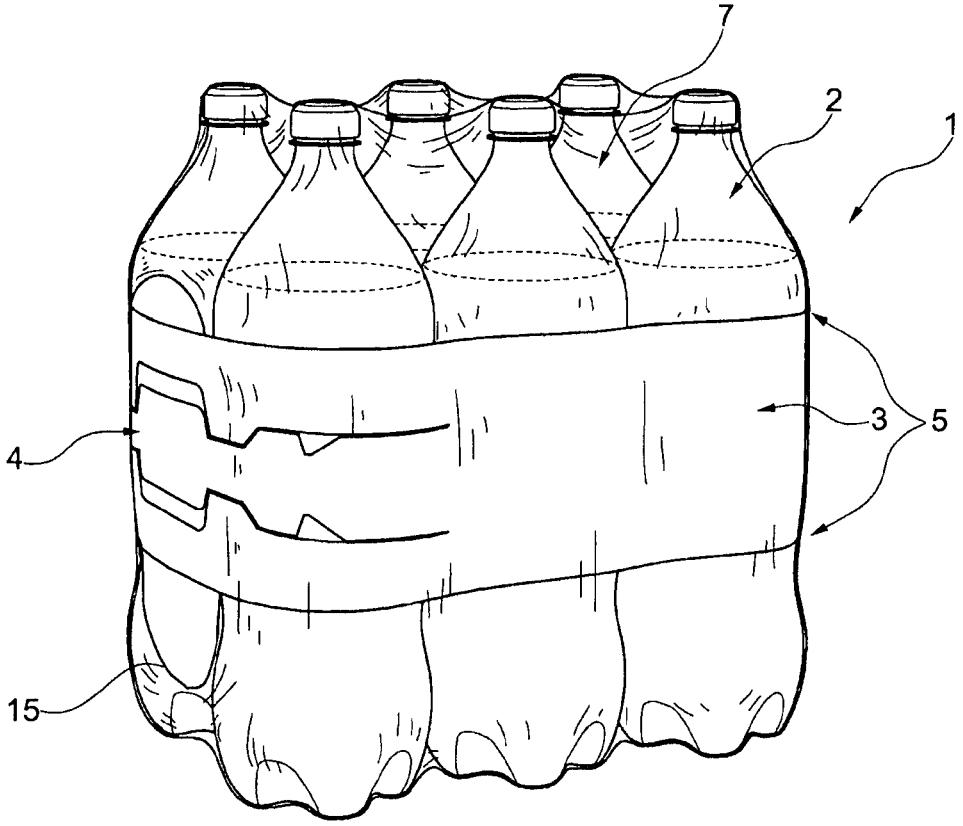
FIG. 1 is a perspective view of a cluster pack.

FIG. 1 shows a cluster pack 1 having a pre-determined number of containers 2. A banner 3 arranged around belly regions 5 of the containers 2 encompasses the containers 2 of the cluster pack 1. A carrying element 4, or an integrated carrying section, is integrated into the banner 3.

In some embodiments, the banner 3 has information printed on it. This information can be a code, such as a barcode or a QR code. The code can be located on an end face.

The cluster pack 1 also has a shrink film 7 that is placed around the containers 2 and the banner 3. The cluster pack thus has an inner encompassing element, namely the banner 3, and an outer encompassing element, namely the shrink film 7.

Figure 2:
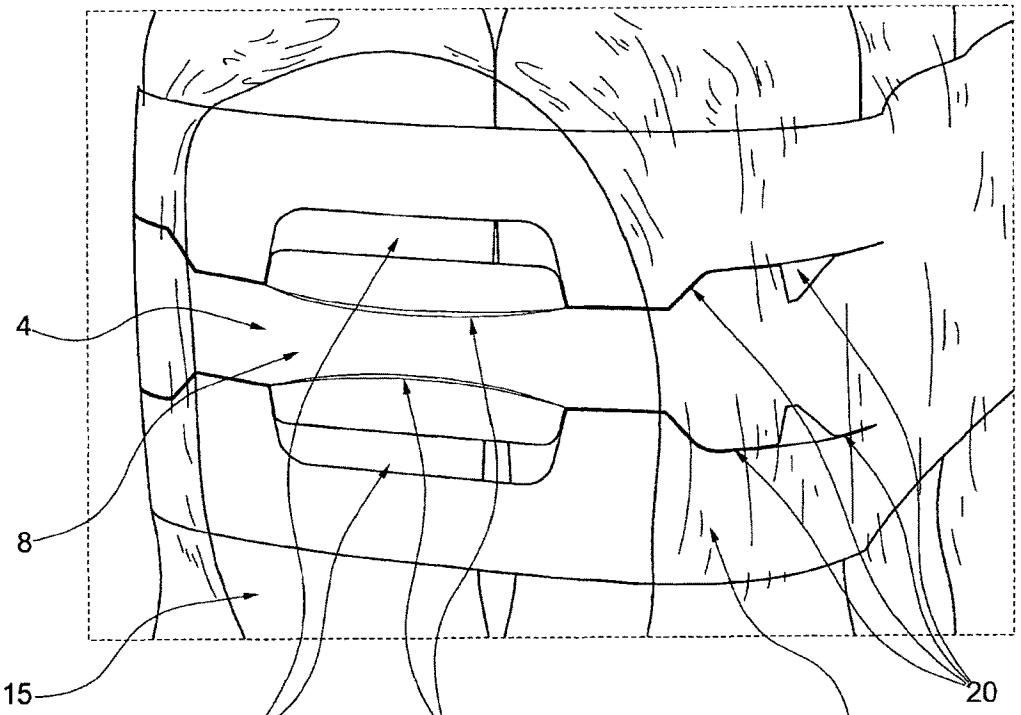
FIG. 2 is an enlarged view of an end face of the cluster pack of FIG. 1.

As shown in FIG. 2, the carrying element 4 is integrated into the banner 3 at an end face thereof. The carrying element 4 comprises grip openings 9 arranged respectively above and below a handle element 8.

In one advantageous embodiment, the handle element 8 has weakened areas of material. Of particular use is a weakened area in the form of lines of weakening 10 that form bendable tabs 11. The lines of weakening 10 are shaped so as to run in a slightly curved manner, with two lines of weakening approach one another at their zenith. When bent in the direction of the handle element 8, particularly backwards behind the handle element 8, the tabs 11 make it easier to effectively grip the handle element 8.

In a further embodiment, the tabs 11 are bent along the line of weakening 10 in a manner oriented away from the cluster pack 1. This forms, in a carrying hand, a carrying element 4 that is triangular when seen in cross-section. A handle of this shape is more comfortable for carrying a heavy cluster pack 1.

When the carrying element 4 is gripped, perforations 20, also referred to as "intended tear sites," on the banner 3 cause the carrying element 4 to be lifted in a manner oriented away from the cluster pack 1, thus forming a handle.

Film ends 12 of the shrink film 7 are glued to the banner 3 at the end faces. Because of a shrink gap 15 that forms at the end faces when the shrink film is shrunk on, the cluster pack 1 is film-free at its end faces. As a result, the film ends 12 do not overlap and also do not butt against one another.

In some embodiments, the containers 2 of the cluster pack 1 are connected to one another at contact surfaces thereof. The connection can be provided by glue or adhesive applied by application stations.

In certain embodiments, the containers 2 in the cluster pack 1 are identically oriented. As a result, it is possible to apply adhesive or glue to the appropriate end face region of one or more corner containers to which the shrink film will be glued.

In other embodiments, an adhesive connects the shrink film ends 12 to the corner containers.

Other embodiments include those in which adhesive or glue is applied to the banner 3 to connect the shrink film ends 12 to the banner 3 at the end faces. An adhesive strip can also be used for this purpose.

Figure 3:
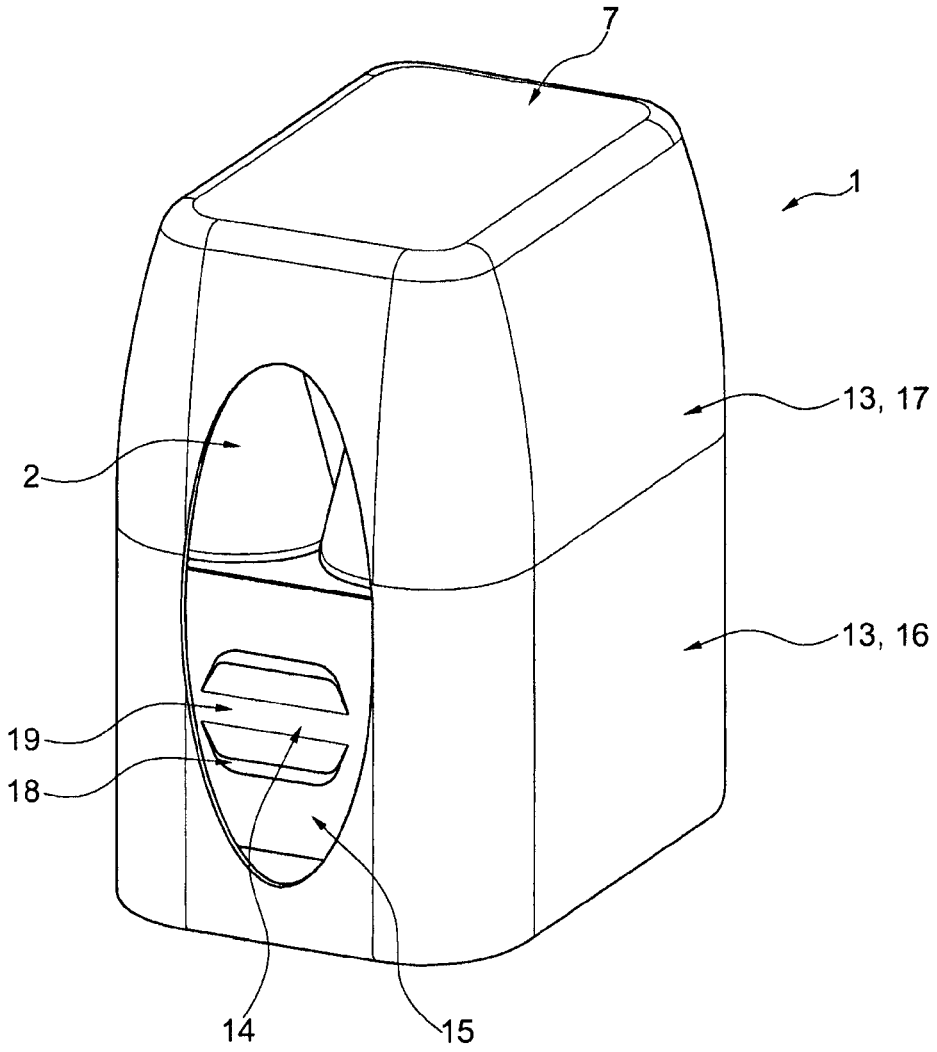
FIG. 3 is a perspective view of a further embodiment of a cluster pack.

FIG. 3 shows a further embodiment of the cluster pack 1 having a pre-determined number of containers 2, which can be bottles. In the illustrated embodiment, the pre-determined number is six.

In FIG. 3, a casing 13 has an integrated carrying element 14. The casing 13 in this case defines an encompassing element. The casing 13 may have information printed thereon. The information can be a barcode or a QR code 6, or any other information communication medium.

In some embodiments, an encompassing element, such as a shrink film 7, surrounds the containers 2 and the casing 13. The components of the casing 13 may be connected to one another in a suitable manner. If no top is provided, however, the shrink film 7 can be used.

The casing 13 has a bottom part 16 and a top part 17. The carrying element 14 is designed as a grip recess 18 with a carrying web 19. The carrying element is preferably arranged in the bottom part 16, so that the top part 17 is merely optional. In cases where the shrink film 7 encompasses the whole cluster pack 1, no top part 17 is needed.

The inner encompassing element 3, 13, which can be a banner 3 or casing 13, defines a ring or band that surrounds the containers 2.

The film ends of the optional shrink film 7 are glued to the banner 3 at the end faces. The cluster pack 1 is film-free at the end faces. Therefore, the film ends 12 neither overlap each other nor butt against one another. This is also the case for the casing 13. At the casing 13, the film ends 12 likewise do not overlap. Additionally, in some embodiments, adhesive or glue holds the film ends 12 to the end faces.

In some embodiments, the containers 2 of the cluster pack 1 are connected to one another. This can be done by providing glue at selected contact surfaces. Suitable application stations may be provided for applying adhesive and glue. Adhesive or glue can also be applied to the casing 13, and in particular to the bottom part 16 and the optional top part 17, at least at the end faces, in order to adhere the shrink film ends 12 to the casing 13 at the end faces. In some embodiments, an adhesive strip is used instead.

Having described the invention, and a preferred embodiment thereof, what is claimed as new, and secured by Letters Patent is:

1. A manufacture comprising a cluster pack, wherein said cluster pack comprises a carrying element, a first encompassing element, a predetermined number of containers, and a second encompassing element, wherein said first encompassing element comprises shrink film that is in contact with tops and bottoms of said containers, wherein said second encompassing element defines a ring that surrounds said containers, wherein said carrying element is integrated into said second encompassing element, and wherein said carrying element comprises grip openings, and a handle element, wherein said handle element comprises lines of weakening, and wherein said lines of weakening define tabs.

2. The manufacture of claim 1, wherein said carrying element comprises a handle having a triangular cross-section.

3. The manufacture of claim 1, wherein said containers have container codes printed thereon, and wherein said ring has a width that is selected to conceal said container codes so that said container codes cannot be read from outside said cluster pack.

4. The manufacture of claim 1, wherein said containers have container codes printed thereon, and wherein said ring is disposed to conceal said container codes so that said container codes cannot be read from outside said cluster pack.

5. The manufacture of claim 1, wherein said second encompassing element comprises an end face, and wherein said integrated carrying element is integrated on said end face.

6. The manufacture of claim 1, wherein said second encompassing element comprises a banner.

7. The manufacture of claim 1, wherein said second encompassing element is arranged around a belly region of said containers.

8. The manufacture of claim 1, wherein said carrying element is disposed on an end face of said cluster pack.

9. The manufacture of claim 1, wherein said lines of weakening comprise a groove.

10. The manufacture of claim 1, wherein said carrying element is disposed along a shrink gap.

11. The manufacture of claim 1, wherein said carrying element is disposed along an opening in said first encompassing element.

12. The manufacture of claim 1, wherein said second encompassing element is arranged inside said first encompassing element.

13. The manufacture of claim 1, further comprising glue, wherein said glue attaches said first encompassing element to surfaces of corner containers of said cluster pack.

14. The manufacture of claim 1, wherein said shrink film wraps at least some areas of said cluster pack, and wherein said shrink film is shrunken onto said cluster pack.

15. The manufacture of claim 14, wherein said second encompassing element comprises a banner, and wherein said shrink film is glued to said banner at an end face of said cluster pack.

16. The manufacture of claim 1, wherein said carrying element is disposed along a gap that forms as a result of ends of said shrink film not overlapping when the shrink film is shrunk on.

17. The manufacture of claim 8, wherein said end face is not a face that is adjacent to tops of said containers.

18. A method for producing a cluster pack having a predetermined number of containers, a shrink film that encompasses said containers, and a carrying element that is integral with a ring that surrounds said containers, wherein said carrying element comprises grip openings and a handle element that comprises lines of weakening define tabs, said method comprising bringing said containers together to form a container arrangement, said container arrangement being conformal to said cluster pack, surrounding said container arrangement with said ring, wrapping said container arrangement, at least in some areas, with said shrink film, wherein wrapping comprises contacting tops and bottoms of said containers with said shrink film, and feeding said wrapped container arrangement to a shrinking device for shrinking of said shrink film around said container arrangement, thereby forming said cluster pack.

19. The method of claim 18, wherein said container arrangement comprises corner containers, wherein said method further comprises applying adhesive to portions of said corner containers, and causing adhesion between said corner containers and said shrink film.

20. The method of claim 18, further comprising causing adhesion between film ends of said shrink film and said ring at an end face of said container arrangement.

21. The method of claim 18, wherein said container arrangement comprises corner containers, wherein said method further comprises applying adhesive to portions of said corner containers, and causing adhesion between said corner containers and said ring.

22. A manufacture comprising a plurality of containers, said plurality of containers comprising a first container and a second container, each of said first and second containers comprising a top surface, a bottom surface, and a surface extending between said top and bottom surfaces, said surface extending between said top and bottom surfaces and comprising first, second, and third portions, said second portions of said first and second containers being oriented to contact each other, a shrink wrap that encompasses said plurality of containers, said shrink-wrap being in contact with said top and bottom surfaces of said containers from said plurality of containers, a ring that surrounds said plurality of containers, said ring being in contact with said first surface of said first container and said first surface of said second container, a carrying element integral with said ring, wherein said third portion of said first container is in contact with neither said ring nor said second container, and wherein said third portion of said second container is in contact with neither said ring nor said first container.

* * * * *